US006471168B1

(12) United States Patent
Tseng

(10) Patent No.: US 6,471,168 B1
(45) Date of Patent: Oct. 29, 2002

(54) MODULAR TABLE LEG ASSEMBLY

(76) Inventor: Chun-Hsien Tseng, No. 3, Ting-Hsi-Hsin, Lu-Man Tsun, Chu-Chi Hsiang, Chiayi Hsien (TW)

( * ) Notice: Subject to any disclaimer, the term of this patent is extended or adjusted under 35 U.S.C. 154(b) by 0 days.

(21) Appl. No.: 09/930,291

(22) Filed: Aug. 16, 2001

(51) Int. Cl.[7] ..... F16M 11/16

(52) U.S. Cl. ..... 248/188; 248/188.1; 248/165; 248/188.8

(58) Field of Search ..... 248/188, 165, 248/440.1, 175, 150, 440, 188.1, 163.1, 188.8; 403/171, 176, 348; 108/157.17, 157, 118, 166, 163.1, 115, 34

(56) References Cited

U.S. PATENT DOCUMENTS 1,172,355 A * 2/1916 Guest ..... 248/165
2,778,700 A * 1/1957 Mayer ..... 108/115
4,354,437 A * 10/1982 Logan ..... 108/157
4,673,092 A * 6/1987 Lamson et al. ..... 248/165
5,074,700 A * 12/1991 Swoboda ..... 403/171
5,327,700 A * 7/1994 Sorenson et al. ..... 52/109
5,645,259 A * 7/1997 Chen ..... 248/436

* cited by examiner

*Primary Examiner*—Korie Chan
*Assistant Examiner*—Gwendolyn Baxter
(74) *Attorney, Agent, or Firm*—Baker Botts L.L.P.

(57) ABSTRACT

A modular table leg assembly is used to support a table top above a ground surface and includes at least three leg members. Each of the leg members include an upright supporting portion, an inclined bracing portion, and male and female engaging units. The upright supporting portion has a lower section and an upper section vertically opposite to the lower section. The inclined bracing portion extends upwardly and inclinedly from the lower section of the upright supporting portion. The inclined bracing portion has a lower first section connected to the lower section of the upright supporting portion and an upper second section opposite to the first section. The male and female engaging units enable the upper section of the upright supporting portion of each of the leg members to engage removably the second section of the inclined bracing portion of an adjacent one of the leg members.

5 Claims, 4 Drawing Sheets

MODULAR TABLE LEG ASSEMBLY

BACKGROUND OF THE INVENTION

1. Field of the Invention

The invention relates to a modular table leg assembly, more particularly to a modular table leg assembly which is easy to install and disassemble, and which has a flexible configuration.

2. Description of the Related Art

Referring to FIG. 1, a conventional table 1 includes a table leg assembly 11 that supports a table top 12 above a ground surface. The table leg assembly 11 has three table leg members 111 that are spaced apart at equal angles, and three stretchers 112, each of which interconnects two adjacent ones of the table leg members 111.

Since the stretchers 112 are connected to the adjacent table leg members 111 by welding and/or screw fasteners, the configuration of the conventional table leg assembly 11 can not be adjusted to suit the shape and/or size of different table tops. Moreover, it is also difficult to move the conventional table leg assembly 11.

SUMMARY OF THE INVENTION

Therefore, the object of the present invention is to provide a modular table leg assembly which is simple in structure and which is easy to install and disassemble.

Another object of this invention is to provide a modular table leg assembly which can be flexibly configured to suit the size and/or shape of a table top.

Accordingly, the modular table leg assembly of this invention is adapted for supporting a table top above a ground surface, and includes at least three leg members. Each of the leg members includes an upright supporting portion, an inclined bracing portion, and male and female engaging units. The upright supporting portion has a lower section adapted to be disposed on the ground surface and an upper section vertically opposite to the lower section. The inclined bracing portion extends upwardly and inclinedly from the lower section of the upright supporting portion. The inclined bracing portion has a lower first section connected to the lower section of the upright supporting portion and an upper second section opposite to the first section. The male and female engaging units are formed respectively at the second section of the upright supporting portion. The male and female engaging units enable the upper section of the upright supporting portion of each of the leg members to engage removably the second section of the inclined bracing portion of an adjacent one of the leg members.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Before the present invention is described in greater detail with reference to the preferred embodiments, it should be noted that like elements are denoted by the same reference numbers in the following description.

Figure 1:
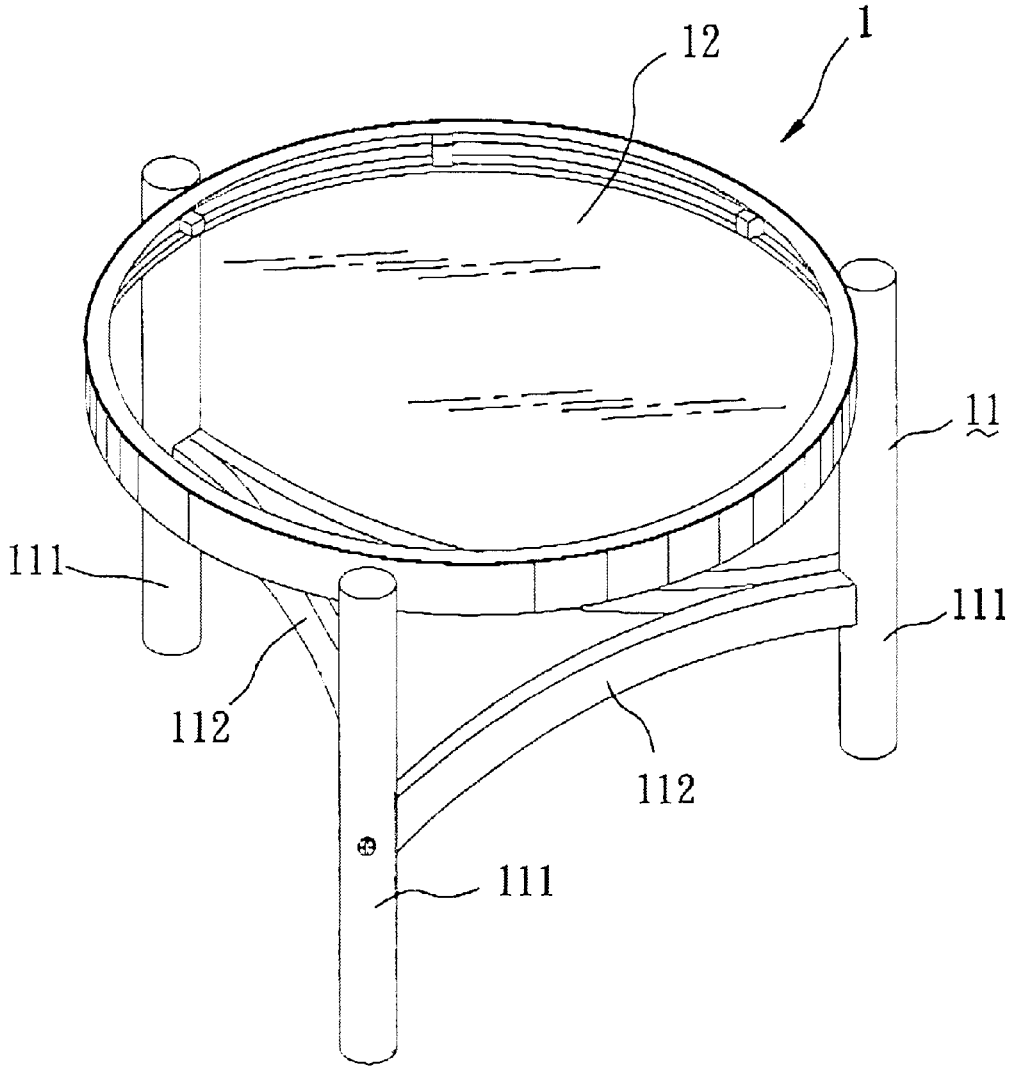
FIG. 1 PRIOR ART
FIG. 1 is a perspective view of a conventional table.
Figure 2:
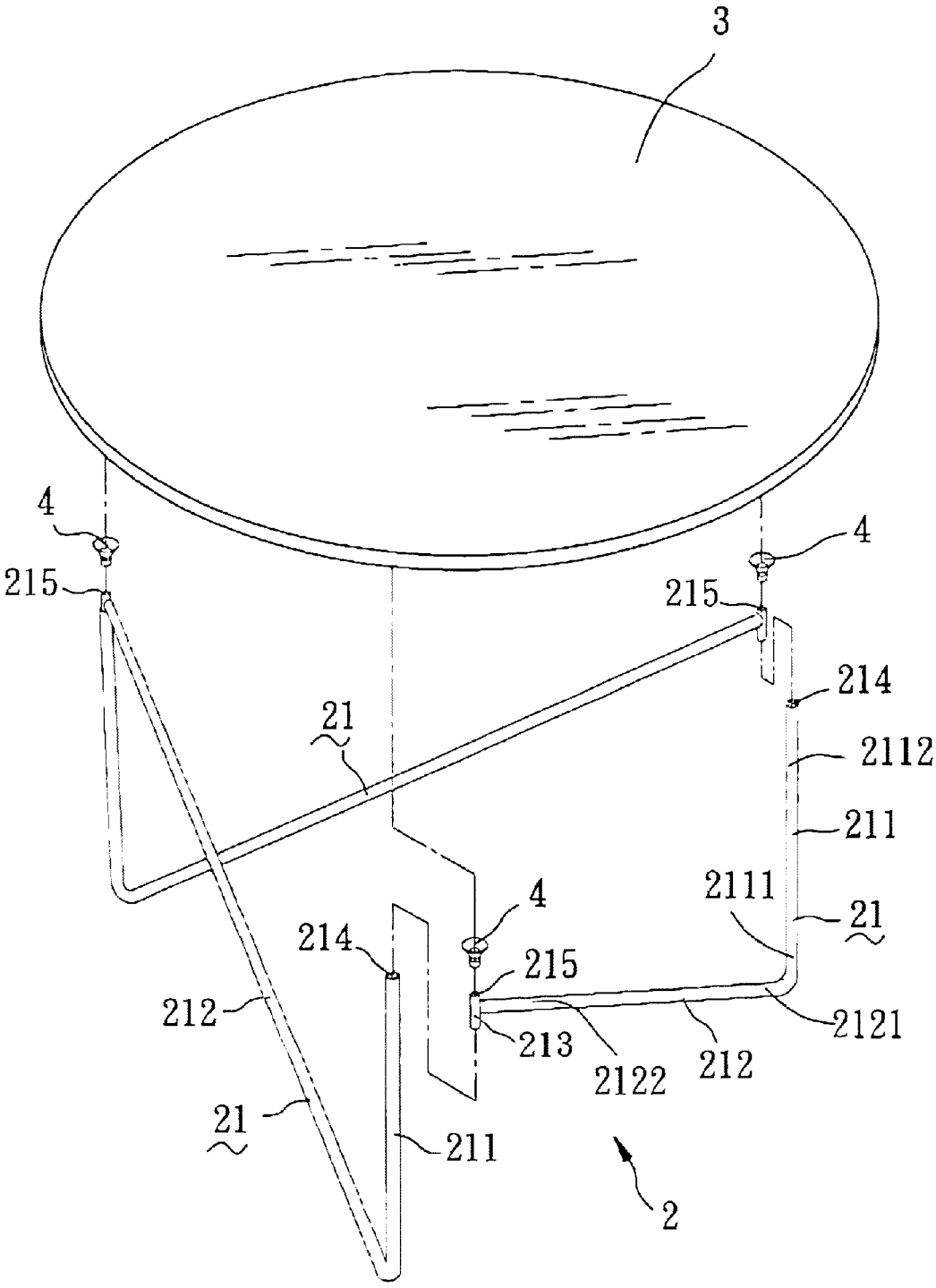
FIG. 2 is an exploded perspective view of the first preferred embodiment of the modular table leg assembly according to this invention.

Referring to FIG. 2, the preferred embodiment of the modular table leg assembly 2 of this invention is adapted for supporting a table top 3 above a ground surface, and is shown to include three leg members 21. Each of the leg members 21 is formed integrally from a hollow metal tube and includes an upright supporting portion 211, an inclined bracing portion 212, and male and female engaging units 213, 214. The upright supporting portion 211 has a lower section 2111 adapted to be disposed on the ground surface and an upper section 2112 vertically opposite to the lower section 2111. The inclined bracing portion 212 extends upwardly and inclinedly from the lower section 2111 of the upright supporting portion 211. The inclined bracing portion 212 has a lower first section 2121 connected to the lower section 2111 of the upright supporting portion 211 and an upper second section 2122 opposite to the first section 2121. The male and female engaging units 213, 214 are formed respectively at the second section 2122 of the inclined bracing portion 212 and the upper section 2112 of the upright supporting portion 211. The male and female engaging units 213, 214 enable the upper section 2112 of the upright supporting portion 211 of each of the leg members 21 to engage removably the second section 2122 of the inclined bracing portion 212 of an adjacent one of the leg members 21.

Preferably, the female engaging unit 214 is formed as an insert hole in the upper section 2112 of the upright supporting portion 211. The insert hole extends along an axis of the upright supporting portion 211. The male engaging unit 213 is formed as an insert pin at the second section 2122 of the inclined bracing portion 212. The second section 2122 of the inclined bracing portion 212 extends toward the upper section 2112 of the upright supporting portion 211 of the adjacent one of the leg members 21 to permit insertion of the insert pin into the insert hole in the adjacent one of the leg members 21.

The second section 2122 of the inclined bracing portion 212 of each of the leg members 21 is further formed with a cup-mounting unit 215. The modular table leg assembly 2 further comprises three suction cups 4, each of which is mounted on the cup-mounting unit 215 of a respective one of the leg members 21 and is adapted to engage one side of the table top 3.

Preferably, the cup-mounting unit 215 on each of the leg members 21 is vertically aligned with and is disposed above the insert pin. In this embodiment, the insert pin and the cup-mounting unit 215 on each of the leg members 21 are formed integrally from a hollow tube.

Figure 3:
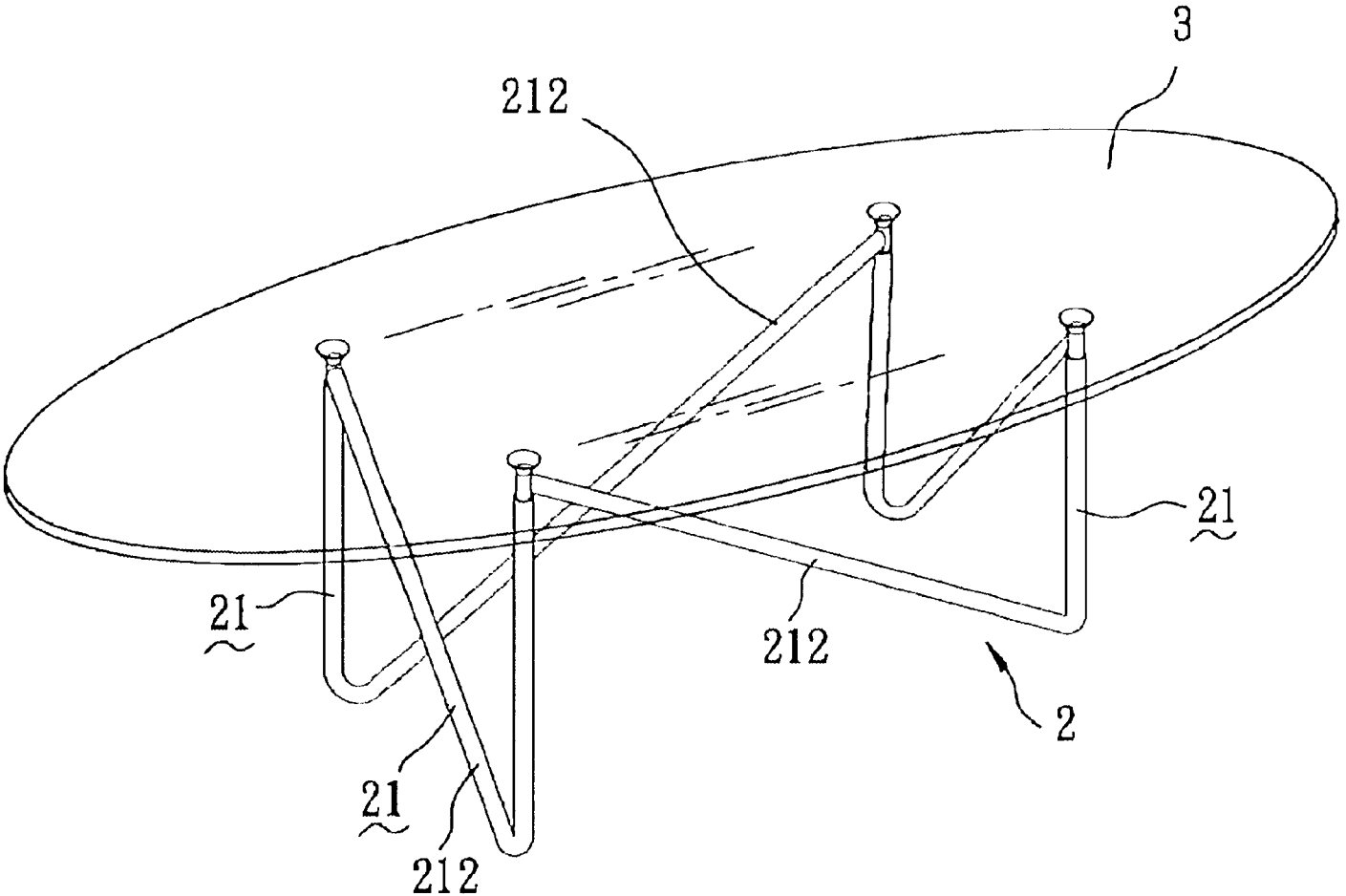
FIG. 3 is a perspective view of the second preferred embodiment of the modular table leg assembly according to this invention.

Referring to FIG. 3, the second preferred embodiment of the modular table leg assembly 2 of this invention is shown to include four leg members 21. Two of the leg members 21 have an inclined bracing portion 212 which is longer than that of the other two of the leg members 21 so as to be adapted to support a rectangular or oval table top 5.

Figure 4:
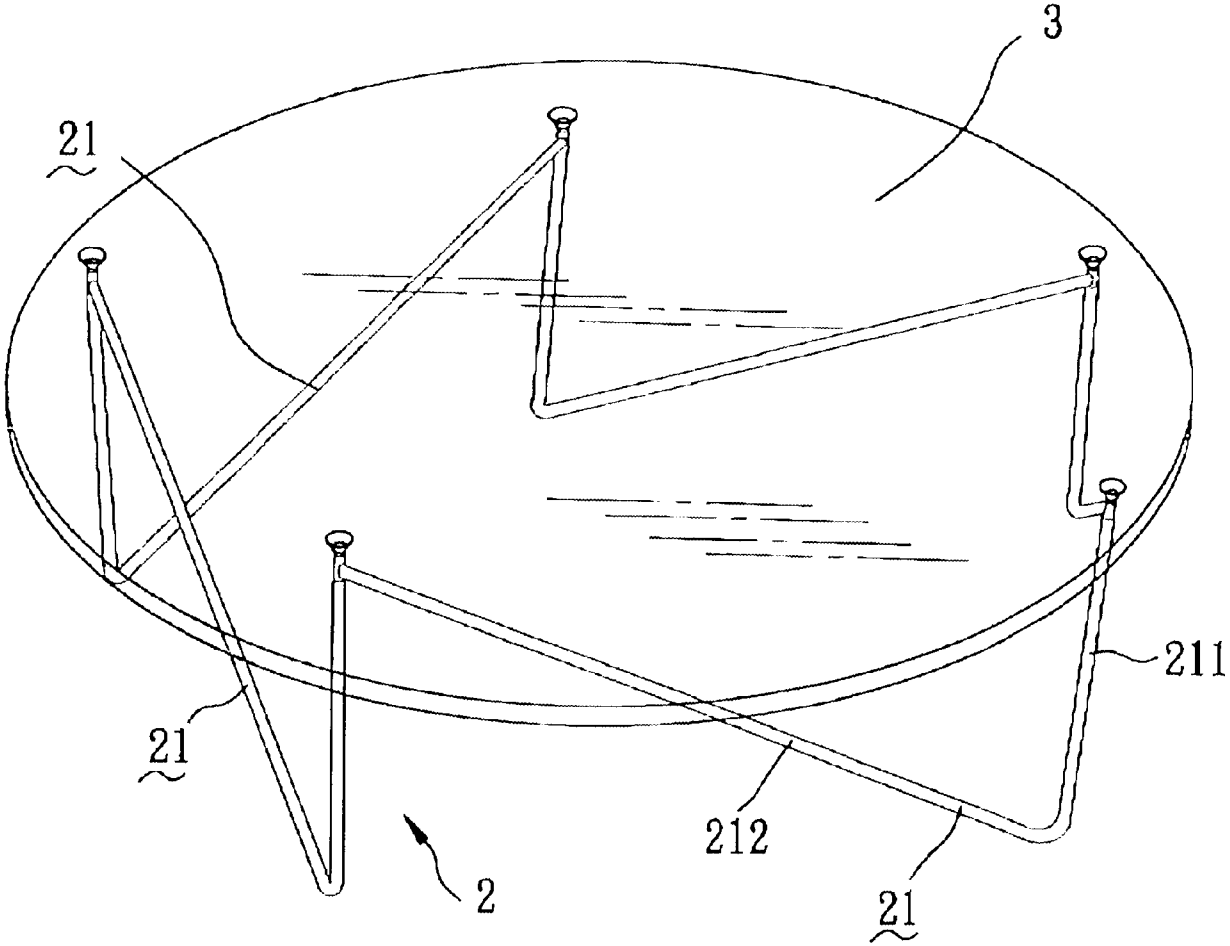
FIG. 4 is a perspective view of the third preferred embodiment of the modular table leg assembly according to this invention.

Referring to FIG. 4, the third preferred embodiment of the modular table leg assembly 2 of this invention is shown to be composed of five leg members 21 so as to be adapted to support a table top 3 with a relatively large area.

In view of the aforesaid, as compared to the conventional table leg assembly, the modular table leg assembly according to this invention is simpler in structure and is easier to install and disassemble. Moreover, the modular table leg assembly according to this invention can be flexibly configured by adjusting the number of the leg members thereof to suit the size and/or shape of a table top.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A modular table leg assembly adapted for supporting a table top above a ground surface, said modular table leg assembly comprising at least three leg members, each of which includes:

an upright support portion having a lower section adapted to be disposed on the ground surface and an upper section vertically opposite to said lower section;

an inclined bracing portion extending upwardly and inclinedly from said lower section of said upright supporting portion, said inclined bracing portion having a lower first section connected to said lower section of said upright supporting portion and an upper second section opposite to said first section; and male and female engaging units formed respectively at said second section of said inclined bracing portion and said upper section of said upright supporting portion, said male and female engaging units enabling said upper section of said upright supporting portion of each of said leg members to engage removably said second section of said inclined bracing portion of an adjacent one of said leg members:

wherein:

said female engaging unit is formed as an insert hole in said upper section of said upright supporting portion, said insert hole extending along an axis of said upright supporting portion;

said male engaging unit being formed as an insert pin at said second section of said inclined bracing portion, said second section of said inclined bracing portion extending toward said upper section of said upright supporting portion of the adjacent one of said leg members to permit insertion of said insert pin into said insert hole in the adjacent one of said leg members.

2. The modular table leg assembly as claimed in claim 1, wherein said second section of said inclined bracing portion of each of said leg members is further formed with a cup-mounting unit, said modular table leg assembly further comprising at least three suction cups, each of which is mounted on said cup-mounting unit of a respective one of said leg members and is adapted to engage one side of the table top.

3. The modular table leg assembly as claimed in claim 2, wherein said cup-mounting unit on each of said leg members is vertically aligned with and is disposed above said insert pin, said insert pin and said cup-mounting unit on each of said leg members being formed integrally from a hollow tube.

4. The modular table leg assembly as claimed in claim 1, wherein each of said leg members is formed integrally from a hollow metal tube.

5. A modular table leg assembly adapted for supporting a table top above a ground surface, said modular table leg assembly comprising at least three leg members, each of which includes:

an upright supporting portion having a lower section adapted to be disposed on the ground surface and an upper section vertically opposite to said lower section;

an inclined bracing portion extending upwardly and inclinedly from said lower section of said upright supporting portion, said inclined bracing portion having a lower first section connected to said lower section of said upright supporting portion and an upper second section opposite to said first section; and male and female engaging units formed respectively at said second section of said inclined bracing portion and said upper section of said upright supporting portion, said male and female engaging units enabling said upper section of said upright supporting portion of each of said leg members to engage removably said second section of said inclined bracing portion of an adjacent one of said leg members.

* * * * *